United States Patent [19]

Iai

[11] Patent Number: 4,704,797

[45] Date of Patent: Nov. 10, 1987

[54] DRAWING DEVICE FOR USE IN A DRAFTING MACHINE AND A DRAWING PENCIL USED THEREWITH

[75] Inventor: Kenichiro Iai, Kurobe, Japan

[73] Assignee: Yoshida Kogyo K.K., Tokyo, Japan

[21] Appl. No.: 898,190

[22] Filed: Aug. 20, 1986

[30] Foreign Application Priority Data

Aug. 30, 1985 [JP] Japan ..... 60-131702[U]
Aug. 30, 1985 [JP] Japan ..... 60-131703[U]

[51] Int. Cl.[4] ..... B43L 13/00

[52] U.S. Cl. ..... 33/18.1; 33/1 M; 346/139 C

[58] Field of Search ..... 33/18.1, 19.2, 19.3, 33/20.1, 32.1, 32.3, 18.2, 1 M; 346/139 C

[56] References Cited

U.S. PATENT DOCUMENTS

| | | | |
|---|---|---|---|
| 4,015,269 | 3/1977 | Edo | 33/18.1 |
| 4,091,393 | 5/1978 | Masuyama et al. | 33/18.1 |
| 4,157,552 | 6/1979 | Nakajima | 33/18.1 |
| 4,157,554 | 6/1979 | Bahr et al. | 346/139 C |
| 4,346,392 | 8/1982 | Isobe et al. | 33/1 M |

*Primary Examiner*—Willis Little

*Attorney, Agent, or Firm*—Hill, Van Santen, Steadman & Simpson

[57] ABSTRACT

A drawing device for use in a drafting machine has a base movable to any desired position; at least one drawing pencil fixedly secured to the base through a holder unit fixed to the latter; a driving arrangement capable of moving part of the drawing pencil longitudinally thereof relative to the base, and a stopper adapted to limit the upward movement of movable component parts of the drawing pencil. The drawing pencil comprises a casing having a lead guide fixedly secured to the leading end thereof; a pipe member slidably mounted in the casing, and having a chuck ring fixedly secured to the lower end thereof, said pipe member having a sleeve tightly fitted and fixedly secured to the outer peripheral surface of the upper part thereof, said sleeve being connected to the driving arrangement; and a lead stock having a space for lead stock formed in the upper part thereof and also having a lead chuck fixedly secured to the lower end thereof so as to achieve lead holding function in cooperation with the chuck ring, said lead stock being slidably mounted in the pipe member. Further, the lead guide has a lead holder bushing which gives a lead holding force more than that afforded by the lead chuck and which is movable vertically within a predetermined extent.

7 Claims, 8 Drawing Figures

DRAWING DEVICE FOR USE IN A DRAFTING MACHINE AND A DRAWING PENCIL USED THEREWITH

BACKGROUND OF THE INVENTION

1. Technical Field of the Invention:

This invention relates to a drawing device for use in a drafting machine and a drawing pencil used therewith, and more particularly to a drawing pencil adapted to thrust a lead continuously and sequentially and an actuator device thereof.

2. Description of the Prior Art

Drawing devices for use in drafting machines adapted to thrust a pencil lead automatically and sequentially are disclosed in, for example, Japanese patent Publication No. 57-36789, Japanese Utility Model Publication No. 57-5193, and West Germany patent Laid-Open Specification No. 32 29 480.0, etc.

Since these prior art drawing devices for use in drafting machines, are not provided with any special mechanism to expel or remove the residual lead, it is necessary to repeat normal lead thrusting operations several or several ten times to enable the residual lead to be pushed out by the next new lead. Therefore, the residual lead expelling operation per se is troublesome and takes a long time, Further, such a lead expelling operation is disadvantageous in that since the length of the lead once thrusted at the leading end of the drawing pencil cannot be adjusted the lead is liable to break.

SUMMARY OF THE INVENTION

The present invention has been contemplated in view of the aforementioned circumstances and for the purpose of eliminating the disadvantages in the prior art.

A first object of the present invention is to provide a drawing device for use in a drafting machine and a drawing pencil used therewith which enable the residual lead to be expelled in a simple way for a short time.

Another object of the present invention is to provide a drawing device for use in a drafting machine and a drawing pencil used therewith which enable the length of projection of the lead from the lead guide in the lead thrusting operation to be kept short to thereby prevent breaking of the lead.

To achieve the aforementioned objects, according to a first aspect of the present invention, there is provided a drawing device for use in a drafting machine comprising a base movable to any desired position; at least one holder unit mounted integrally on the base; at least one drawing pencil fixedly mounted on the holder unit; a driving arrangement capable of moving a part of the drawing pencil longitudinally thereof relative to the base; and a stopper means adapted to limit the upward movement of movable component parts of said drawing pencil relative to the base.

According to the present invention, the above-mentioned drawing pencil comprises, in the above-mentioned first aspect, a casing fixedly secured to the holder unit; a lead guide fixedly secured to the lower end of the casing; a pipe member slidably mounted in the casing; a chuck ring fixedly secured to the lower end of the pipe member; a sleeve tightly fitted and fixedly secured to the outer peripheral surface of the upper part of the pipe member and connected to the driving arrangement; a lead stock slidably mounted in the pipe member and having a space for the lead stock and a lead insertion hole formed or perforated longitudinally in the upper and lower parts thereof, respectively; a lead chuck fixedly secured to the lower end of the lead stock and having a longitudinally extending lead insertion hole which communicates rectilinearly with the lead insertion hole in the lead stock, the lead chuck being capable of deforming or expanding and contracting radially so as to achieve its lead holding function in cooperation with the chuck ring; a first coiled spring mounted between the chuck ring and the chuck stock so as to bias normally upwards the lead stock and the lead chuck relative to the pipe member and the chuck ring; and a means for radially contracting the lead chuck to enable the lead to be held by the lead chuck when the latter is biased upwards by the resilient force of the coiled spring relative to the chuck ring.

Further, according to the present invention, the lead guide for use in the drawing pencil has a large diameter hole, a small diameter hole and a lead insertion hole formed continuously, concentrically and sequentially from the upper part to the lower part, the lead guide comprising a holding cylinder fitted in and fixedly secured to the large diameter hole; a lead holder bushing inserted in the holding cylinder and the small diameter hole so as to be moved up and down freely and having a large diameter outer peripheral portion kept in sliding contact with the inner peripheral surface of the holding cylinder on the side of the latter, an outer peripheral portion kept in sliding contact with the inner peripheral surface of the small diameter hole on the side of the latter, and a lead insertion hole formed in the central part thereof, the lead holder bushing being capable of slightly expanding and contracting in the radial direction; and a second coiled spring mounted between the annular lower surface of the large diameter outer peripheral portion of the lead holder bushing and the bottom surface of the large diameter hole so as to bias normally upwards the lead holder bushing, wherein the lead holding force afforded by the lead holder bushing is of a sufficient magnitude not only to prevent the lead from dropping by its own weight in the course of downward movement of the lead, but also to enable the lead chuck with the lead held thereby to be moved upwards through the lead against the resilient force of the first coiled spring in the course of upward movement of the lead holder bushing by the resilient force of the second coiled spring, whilst with regard to the upward movement of the lead, in case the pipe member is moved upwards under the condition the lead is held, the lead holding force afforded by the lead holder bushing surpasses that given by the lead chuck so that the lead holding effect given by the lead chuck may be released or eliminated.

Still further, according to the present invention, the above-mentioned driving arrangement connected to the sleeve of the drawing pencil comprises a pair of rollers; that is, a forwardly and reversely rotatable drive roller, arranged to be urged in contact with the outer peripheral surface of the sleeve, and a forwardly and reversely rotatable driven or follower roller.

According to a second aspect of the present invention to achieve the aforementioned objects, in the drawing device according to the first aspect, the driving arrangement connected to the sleeve of the drawing pencil comprises a pair of drive and driven pinions, and racks formed in the outer peripheral surface of the sleeve so as to be engaged with the pinions, respectively, wherein the pinions are rotatable forwardly and reversely.

To achieve the above-mentioned objects, according to a third aspect of the present invention, the above-mentioned drawing pencil according to the first aspect comprises further a coiled spring loosely mounted on the outer peripheral surface of the pipe member between the upper end surface of the casing and the lower end face of the sleeve so as to allow said pipe member to project through the sleeve to its predetermined upper position relative to the casing.

According to a fourth aspect of the present invention to achieve the aforementioned objects, there is provided a drawing pencil comprising a casing; a lead guide fixedly secured to the lower end of the casing; a pipe member slidably mounted in the casing; a chuck ring fixedly secured to the lower end of the pipe member; a sleeve tightly fitted and fixedly secured to the outer peripheral surface of the upper part of the pipe member; a lead stock slidably mounted in the pipe member and having a space for lead stock and a lead insertion hole formed or perforated longitudinally in the upper and lower parts thereof, respectively; a lead chuck fixedly secured to the lower end of the lead stock and having a longitudinally extending lead insertion hole formed therein so as to communicate rectilinearly with the lead insertion hole formed in the lead stock, the lead chuck being capable of deforming or expanding and contracting radially so as to achieve its lead holding function in cooperation with the chuck ring; a first coiled spring mounted between the chuck ring and the chuck stock so as to bias normally upwards the lead stock and the lead chuck relative to the pipe member and the chuck ring; and a means for radially contracting the lead chuck to enable the lead to be held by the lead chuck when the latter is biased upwards by the resilient force of the first coiled spring relative to the chuck ring; and a coiled spring loosely mounted on the outer peripheral surface of the pipe member between the upper end surface of the casing and the sleeve so as to allow the pipe member to project through the sleeve to its predetermined upper position relative to the casing.

The above-mentioned and other many advantages, aspects and objects of the present invention will become apparent to those skilled in the art when reference is made to the following description and accompanying drawings in which preferred embodiments incorporating the principle of the present invention are shown.

DETAILED DESCRIPTION OF THE INVENTION

A drawing device for use in a drafting machine and a drawing pencil used therewith according to the present invention will now be described below in more detail with reference to the accompanying drawings.

Figure 1:
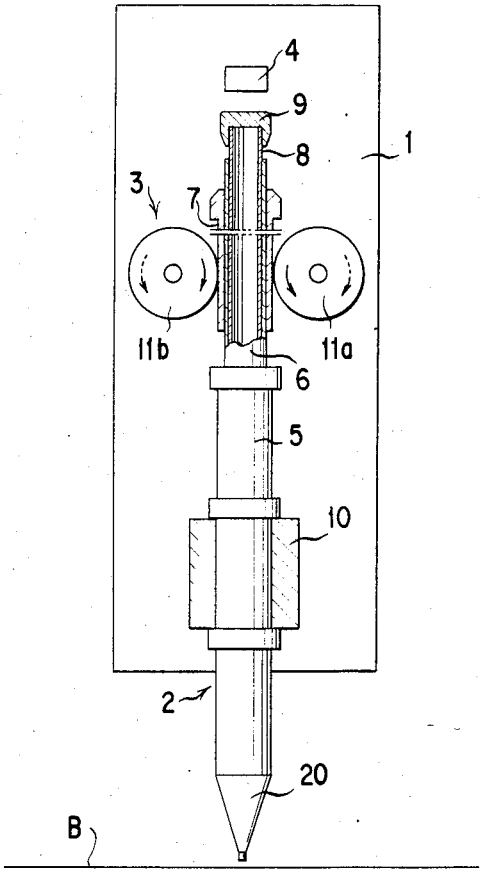
FIG. 1 is a schematic front view showing generally one embodiment of drawing device for use in a drafting machine according to the present invention.

Referring first to FIG. 1 which is a schematic front view of a drawing device for use in a drafting machine of the present invention the drawing device comprises a base or rest 1 movable by a moving arrangement not shown in any desired direction, a drawing pencil 2 mounted on the base 1, a driving arrangement 3 located on one side of the drawing pencil 2 and adapted to move a part of the pencil 2, and a stopper 4 located above the rear end of the drawing pencil 2.

The drawing pencil 2 for use in the drawing device has a substantially cylindrical casing 5 which comprises a lead guide 20 at the leading end thereof. A pipe member 6 is slidably inserted in the casing 5. The upper, outer peripheral portion of the pipe member 6 projecting from the casing 5 has a sleeve member 7 integrally mounted thereon. Further, slidably inserted in the inner periphery of the pipe member 6 is a lead stock 8 which has a lead insertion hole formed in the leading end thereof and which has a lead stock space formed in the upper part thereof.

Further, a cap 9 is detachably mounted on the rear end of the lead stock 8 in such a manner as to enable a spare lead to be supplied.

The casing 5 is adapted to be held by the base 1 through a holder fixedly and integrally secured to the latter. Whilst, the sleeve member 7 has a drive roller 11*a* and a driven or follower roller 11*b* adapted to be rotated freely forwardly and reversely and which are urged to contact with the outer periphery thereof whereby constituting a driving arrangement 3.

Figure 2A:
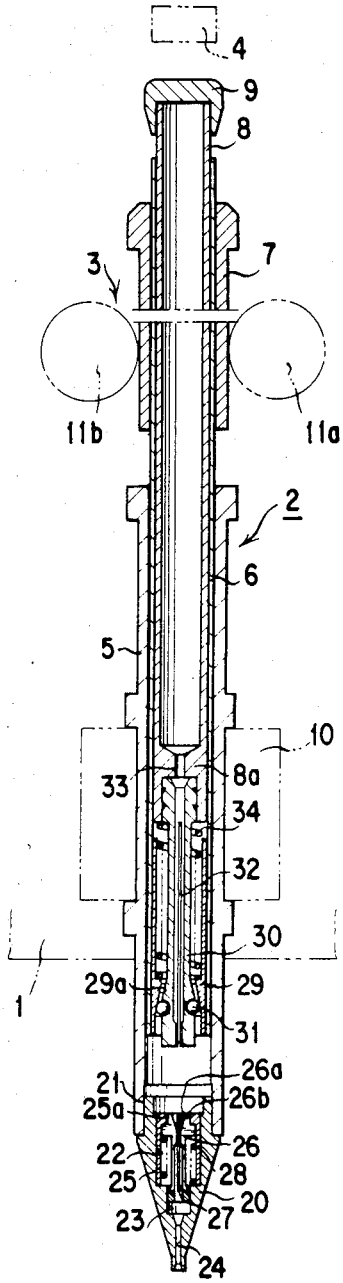
FIG. 2A is a sectional view showing one embodiment of drawing pencil used with the drawing device for use in a drafting machine according to the present invention.

The above-mentioned drawing pencil 2 will be described below in more derail with reference to FIG. 2*a*.

Mounted on the leading end of the cylindrical casing 5 through a mounting stepped portion 21 is a lead guide 20, which has a large diameter hole 22, a small diameter hole 23, and a lead insertion hole 24 formed continuously and concentrically therein. A holding cylinder 25 is tightly fitted in and fixedly secured to the large diameter hole 22. A lead holder bushing 26 is vertically, movably inserted in both the holder cylinder 25 and the small diameter hole 23. The lead holder bushing 26 has an open slit 27 formed in the upper part thereof to allow its diametrical deformation to some degree. Further, the lead holder bushing 26 has an upwardly enlarged or divergent, funnel-shaped inlet 26*a* for a lead formed therein to facilitate insertion of it. Still further, the lead holder bushing 26 is biased by the resilient force of a coiled spring 28 at its upper position where the upper small diameter portion 26*b* thereof is fitted in an aperture 25*a* of the holding cylinder 25, and is also adapted to be moved to its lowermost position against the force of the coiled spring 28 to thereby enable it to abut against the bottom of the small diameter hole 23.

Fitted in and fixedly secured to the lower part of the pipe member 6 slidably inserted in the upper part of the casing 5 is a chuck ring 29 whose inner peripheral surface 29*a* is of a downwardly enlarged or divergent taper configuration. Steel balls 31 fitted in the outer peripheral surface of the lower part of a lead chuck 30 are held in contact with the inner peripheral surface 29*a*.

The above-mentioned lead chuck 30 has an open slit 32 formed in the lower part thereof so as to permit its diametrical deformation, i.e., expansion and contraction. The upper part of the lead chuck 30 is fitted in and fixedly secured to the lower part of the cylindrical lead stock 8 slidably inserted in the upper part of the pipe member 6. A lead insertion hole 33 perforated in the bottom part of the lead stock 8 is open concentrically with the lead chuck 30. Further, a coiled spring 34 is mounted between the chuck ring 29 and the lower end face of the lead stock 8. The chuck ring 29 and the lead chuck 30 are biased by the coiled spring 34 in such a direction as to be spaced apart relative with each other to thereby urge the steel balls 31 in contact with the inner peripheral surface 29*a* of the chuck ring 29 so that the lead chuck 30 may deform or contract diametrically to hold the lead firmly.

Figure 2B:
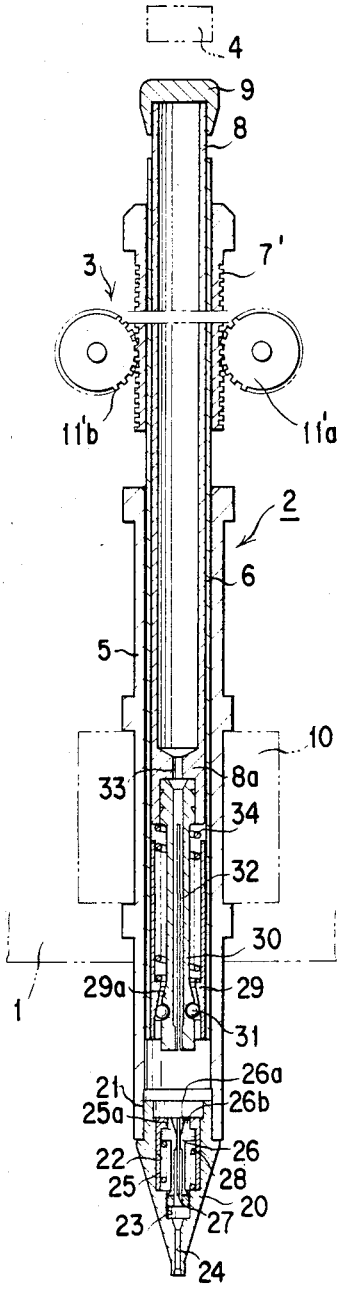
FIG. 2B is a sectional view showing another embodiment of the drawing device of the present invention.

Further, as shown in FIG. 2B, according to another embodiment of the drawing device of the present invention, the driving arrangement 3 to move a part of the drawing pencil 2 comprises racks formed in the peripheral surface of the sleeve 7' and a pair of drive and driven pinions 11'*a* and 11'*b* arranged to be engaged with the racks, respectively, and rotatable forwardly and reversely.

According to the drawing pencil 2 of the present invention, the lead holding force afforded by the lead holder bushing 26 is enough not only to prevent a lead $A_1$ from falling by its own weight during its downward movement, but also to move upwardly the lead chuck 30 with the lead $A_1$ held thereby through the lead $A_1$ against the resilient force of the coiled spring 34 when the lead holder bushing 26 is moved upwards by the resilient force of a coiled spring 28. Whilst, regarding the upward movement of the lead $A_1$, in case the pipe member 6 is moved upwards by the driving arrangement 3 under the condition the lead $A_1$ is held by the lead chuck 30, the lead holding force afforded by the lead holding bushing 26 will overcome that given by the lead chuck 30 with the result that the lead holding force given by the latter is released.

The operation of the drawing device for use in a drafting machine and the drawing pencil 2 according to the present invention constructed as mentioned above will be described below in detail with reference to FIGS. 3 to 6.

When the cap 9 is depressed by, for example, the forefinger of a draftman or operator while the drive roller 11*a* is stopped so as to hold the sleeve 7 stationary, the lead stock 8 is slidably moved along the pipe member 6 towards the leading end of the drawing pencil 2 (hereinafter referred to merely as "moved down or downwards") to move the lead chuck 30 downwards against the resilient force of the coiled spring 34. As a result, the steel balls 31 will disengage from the inner peripheral surface 29*a* of the chuck ring 29 to thereby expand diametrically so that the pencil lead $A_1$ in the lead stock 8 may pass through the lead stock 30 and drop freely to the lead inlet 26*a* of the lead holder bushing 26.

Successively, when the depression force applied on the cap 9 is released, the lead chuck 30 is moved towards the rear end of the drawing pencil 2 (hereinafter referred to simply as "moved up or upwards") by the resilient force of the coiled spring 34 so as to urge the steel balls 31 in contact with the inner peripheral surface 29*a* of the chuck ring 29 to enable the lead chuck 30 to hold the pencil lead $A_1$.

Under this condition, when the drive roller 11*a* is rotated forwardly as shown by arrow to slidably move the pipe member 6 downwards through the sleeve 7, the lead chuck 30 is moved downwards together with the lead stock 8 to thereby move the pencil lead $A_1$ downwards.

Thus, the forward rotation of the drive roller 11*a* causes the pencil lead $A_1$ to be thrusted down sequentially. When the lowest end face of the pipe member 6 is allowed to about against the uppermost end face of the lead guide 20, the downward movement of the pipe member 6 is stopped at the lowermost position (the stroke end) thereby finishing the first thrusting operation of the pencil lead $A_1$.

Upon completion of the above-mentioned lead thrusting stroke of one time, the drive roller 11*a* is rotated reversely so as to slidably move the pipe member 6 upwards through the sleeve 7. At that time, since the pencil lead $A_1$ remains held by the lead holder bushing 26, the lead stock 8 and the lead chuck 30 are not allowed to slidably move temporarily in the upward direction, and only the chuck ring 29 will be moved upwards together with the pipe member 6. As a result, the leading end portion of the lead chuck 30 will deform or expand diametrically to release or eliminate its lead holding force thereby rendering the lead chuck 30 and the pencil lead $A_1$ free with each other. From this condition, when the reverse rotation of the drive roller 11*a* is continued further, the lead chuck 30 is now moved upwards together with the lead stock 8 along the pencil lead $A_1$ to a predetermined upper position thereof by the pipe member 6 through the coiled spring 34. At that time, since the lead holder bushing 26 is moved by the resilient force of the coiled spring 28 at a slight distance from its lower position (where the lowest end surface of the lead holder bushing 26 is held in contact with the bottom surface of the small diameter hole 23 of the lead guide 20) to its uppermost position (where the upper surface of the large diameter portion of the lead holder bushing 26 is kept in contact with the lower surface of the lower surface of the small diameter stepped portion of the aperture 25*a* of the holding cylinder 25), the pencil lead $A_1$ fixedly held by the lead holder bushing 26 is also moved upwards by the same distance as the moved distance of the lead holder bushing 26.

Thereafter, the next lead thrusting stroke can be commenced in the aforesaid manner by rotating forwardly the drive roller 11*a* again while keeping the pencil lead $A_1$ held at a rearer portion thereof by the lead chuck 30. As a result, the lead $A_1$ will pass through the lead holder bushing 26 and project out through the lead insertion hole 24 of the lead guide 20.

Thus, the sliding movement of the pipe member 6 from its predetermined upper position to its lowermost position enables the pencil lead $A_1$ to be thrusted continuously and smoothly.

Figure 3:
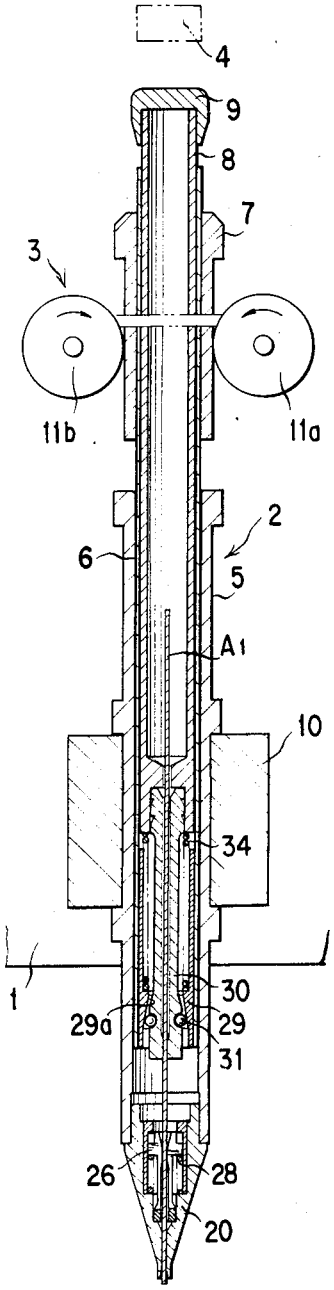
FIG. 3 is a sectional view illustrating the drawing pencil of FIG. 2A under lead thrusting condition.

Further, when the pencil lead $A_1$ passes through the lead holder bushing 26, the latter is slidably moved downwards to its lowest position against the resilient force of the coiled spring 28 as shown in FIG. 3. Accordingly, when the drive roller 11*a* is stopped in the course of thrusting the pencil lead $A_1$ and then slightly rotated reversely from the above condition, the lead holder bushing 26 will slidably move to its upper position as shown in FIG. 2A so as to retract the pencil lead $A_1$ within the lead guide 20. On the other hand, the lead guide 20 do not move upwards and downwards, and therefore the lead guide 20 can be positioned near sufficiently the paper B to enable the length of projection of the pencil lead $A_1$ to be reduced to thereby minimize possibility of breaking of the pencil lead $A_1$.

Figure 4:
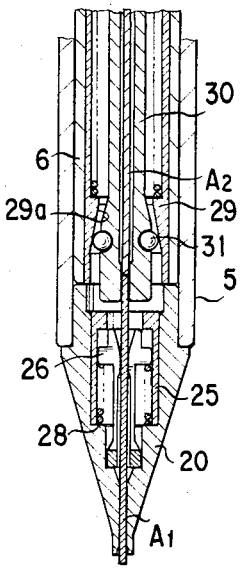
FIGS. 4, 5 and 6 are explanatory sectional views showing residual lead expelling operations in the drawing pencil shown in FIG. 2A.
Figure 5:
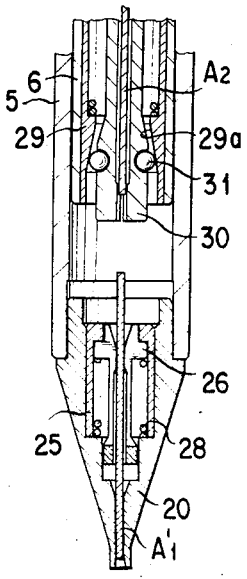
Figure 6:
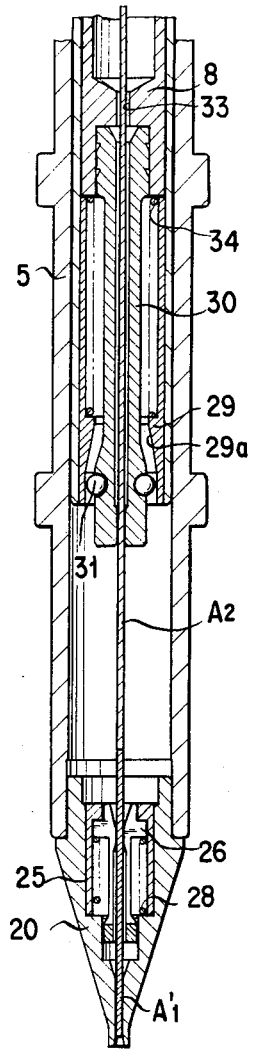

When the overall length of the pencil lead $A_1$ has been reduced after several times of lead thrusting strokes, as shown in FIG. 4, the drive roller 11*a* is rotated reversely to slidably move the pipe member 6 to its predetermined upper position. At that time, as in the case of repetition of lead thrusting strokes as mentioned earlier, the effect of holding the rear end of the pencil lead $A_1$ by the lead chuck 30 is released by the lead holding force given by the lead holder bushing 26 to allow the lead $A_1$ to be disengaged from the lead chuck 30. In case the lead $A_1'$ whose length has been reduced is held by the lead guide 20, that is; under the condition a short lead remains held, it is necessary to remove the remaining lead $A_1'$.

In this case, it is only necessary to detect the remaining lead condition by means of any electrical means such as, for example, a photoelectric sensor, and rotate the drive roller 11*a* reversely further by means of a detection signal then generated so as to slidably move the pipe member 6 further upwards from its predetermined upper position at the time of normal thrusting of the lead. As a result, the cap 9 will abut against the stopper 4 so as not to allow upward movement of the lead stock 8 and the lead chuck 30. Further continuous reverse rotation of the drive roller 11*a* moving the pipe member 6 upwards causes the chuck ring 29 to be moved upwards against the resilient force of the coiled spring 34, so as to disengage the steel balls 31 from the inner peripheral surface 29*a*. Consequently, the lead holding force afforded by the lead chuck 30 is eliminated, and a new lead $A_2$ will freely drop by its own weight to enable the leading end of the new lead $A_2$ to abut against the rear end of the residual lead $A_1'$. If the drive roller 11*a* is rotated forwardly under such a condition to slidably move the pipe member 6 downwards so as to move the cap 9 away from the stopper 4, the new lead $A_2$ will be held by the lead chuck 30. Further continuous forward rotation of the drive roller 11*a* causes the new lead $A_2$ to be moved downwards by the downward movement of the pipe member 6 which results in the residual lead $A_1'$ being thrusted and driven out by the new lead $A_2$ from the lead holder 20.

After the residual lead $A_1'$ has been expelled, the aforementioned procedure to be taken after completion of thrusting of the lead is made, and then drawing operation using the new lead $A_2$ is carried out.

Next, an embodiment where the drawing pencil 2 is used alone will be described with reference to FIG. 7.

Figure 7:
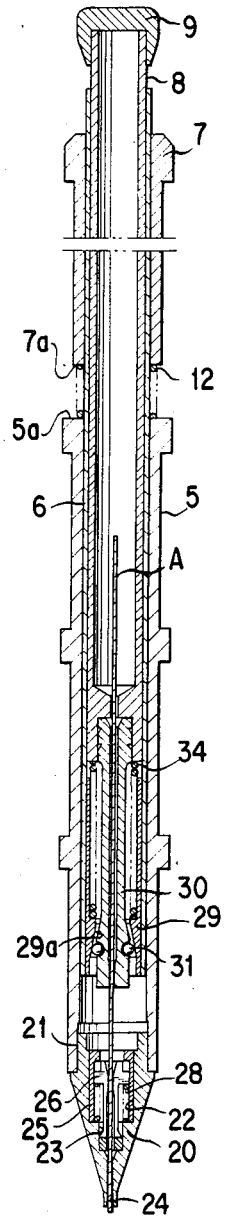
FIG. 7 is a sectional view showing another embodiment of drawing pencil used with the drawing device for use in the drafting machine according to the present invention.

Since the component parts shown in FIG. 7 and designated by same reference numerals as those of the aforementioned drawing pencil 2 have the same functions as those of the embodiment of the latter, the description of them is omitted to avoid duplication.

The second embodiment shown in FIG. 7 differs from the first embodiment in that a coiled spring 12 is loosely mounted on the pipe member 6 between the lower end surface 7*a* of the sleeve 7 and the upper end surface 5*a* of the casing 5. The two ends of this coiled spring 12 are fixedly secured to the lower end surface 7*a* of the sleeve 7 and the upper end surface 5*a* of the casing 5, respectively. The pipe member 6 fixedly secured to the sleeve 7 is held at its predetermined upper projecting position by the resilient force of the coiled spring 12.

Next, the operation of the second embodiment will be described.

When the cap 9 is depressed while the casing 5 and the sleeve 7 is held by one hand, the lead stock 8 is slidably moved downwards along the pipe member 6 to move the lead chuck 30 downwards against the force of the coiled spring 34. As a result, the steel balls 31 are allowed to disengage from the inner peripheral surface of the chuck ring 29 and expand diametrically so as to enable the lead A within the lead stock 8 to pass through the lead chuck 30 and then drop to the lead inlet 26*a* of the lead holder bushing 26.

When the depression force on the cap 9 is released under such a condition, the lead chuck 30 is moved upwards by the force of the coiled spring 34 so as to urge the steel balls 31 to contact with the inner peripheral surface 29*a* of the chuck ring 29 thereby enabling the lead A to be held by the lead chuck 30.

When the pipe member 6 is slidably moved so as to thrust into the casing 5 against the force of the coiled spring 12 while the casing 5 is held by one hand, the lead chuck 30 is moved downwards together with the lead stock 8 to allow the lead A to be moved downwards. As a result, the lead A will pass through the lead holder bushing 26 and project down from the lead insertion hole 24 of the lead guide 20. Therefore, the lead A is thrusted sequentially by thrusting the pipe member 6 down continuously. When the pipe member 6 is continuously pushed down until the lower end surface of the pipe member 6 abuts against the upper surface of the lead guide 20, the thrusting-down operation of the pipe member 6 is stopped at the lowermost position thereof to thereby stop thrusting of the lead.

Further, upon release of the depressing force applied on the pipe member 6, the latter is slidably moved upwards by the coiled spring 12 through the sleeve 7 to its predetermined projecting position. At that time, since the lead A is held by the lead holder bushing 26, the lead chuck 30 will deform or expand diametrically to release the holding force exerted by the lead chuck 30 on the lead A. Consequently, the lead chuck 30 is moved upwards together with the lead stock 8 by the pipe member 6 through the coiled spring 34. Whilst, since the lead holder bushing 26 is biased by the resilient force of the coiled spring 28 to move upwards at a slight distance from its lowest position to its uppermost position, the pencil lead A fixedly held by the lead holder bushing 26 is allowed to retract within the lead guide 20 by the same distance as that of the upward movement of the lead holder bushing 26.

Subsequently, the pencil lead A can be thrusted down and out in the same manner as mentioned above by pushing the pipe member 6 down through the sleeve 7.

Thus, the length of the pencil lead A projecting out from the lead insertion hole 24 in the lead guide 20 can be adjusted as desired. Therefore, the length of projection of the pencil lead can be selected depending on the purpose for use.

Further, other functions can be achieved by the same operation as that for the aforementioned first embodiment. However, this embodiment differs from the first embodiment only in that the upward and downward movements of the pipe member 6 and the operation of the stopper 4 need to be done by the hand of a draftman or operator.

It is to be understood that the foregoing description is merely illustrative of preferred embodiments of the present invention, and that the scope of the invention is not to be limited thereto, but is to be determined by the scope of the appended claims.

What is claimed is:

1. A drawing device for use in a drafting machine comprising:

a base movable to any desired position;

at least one holder unit mounted integrally on the base, at least one drawing pencil fixedly mounted on the holder unit;

a driving arrangement capable of moving part of the drawing pencil longtitudinally thereof relative to said base; and a stopper means adapted to limit the upward movement of movable componenent parts of said drawing pencil relative to the base, said drawing pencil comprising (a) a casing fixedly secured to said holder unit;

(b) a lead guide fixedly secured to the lower end of the casing;

(c) a pipe member slidably mounted in said casing;

(d) a chuck ring fixedly secured to the lower end of the pipe member;

(e) a sleeve tightly fitted and fixedly secured to the outer peripheral surface of the upper part of the pipe member and connected to said driving arrangement;

(f) a lead stock slidably mounted in said pipe member and having a space for the lead stock and a lead insertion hole formed or perforated longitudinally in the upper and lower parts thereof, respectively;

(g) a lead chuck fixedly secured to the lower end of the lead stock and having a longitudinally extending lead insertion hole which communicates rectilinearly with the lead insertion hole in said lead stock, said lead chuck being capable of deforming or expanding and contracting radially so as to achieve its lead holding function in cooperation with said chuck ring;

(h) a first coiled spring mounted bedtween said chuck ring and said lead stock so as to bias normally upwards the lead stock and the lead chuck relative to said pipe member and said chuck ring; and (i) a means for radially contracting the lead chuck to enable the lead to be held by the lead chuck when the latter is biased upwards by the resilient force of the coiled spring relative to the chuck ring.

2. The drawing device as claimed in claim 1, characterized in that said lead guide has a large diameter hole, a small diameter hole, and a lead insertion hole formed continuously, concentrically and sequentially from the upper part to the lower part, said lead guide comprising:

(a) a holding cylinder tightly fitted in and fixedly secured to said large diameter hole;

(b) a lead holder bushing inserted in the holding cylinder and the small diameter hole so as to be moved up and down freely and having a large diameter outer peripheral portion kept in sliding contact with the inner peripheral surface of the holding cylinder on the side of the latter, an outer peripheral portion kept in sliding contact with the small diameter hole on the side of the latter, and a lead insertion hole formed in the central part thereof, said lead holder bushing being capable of slightly expanding and contracting in the radial direction; and (c) a second coiled spring mounted between the annular lower surface of the large diameter outer peripheral portion of the lead holder bushing and the bottom surface of said large diameter hole so as to bias normally the lead holder bushing upwards, wherein the lead holding force afforded by the lead holder cylinder is of a sufficient magnitude not only to prevent the lead from dropping by its own weight in the course of downward movement of the lead, but only to enable the lead chuck with the lead held thereby to be moved upwards through the lead against the resilient force of the first coiled spring in the course of upward movement of the lead holder bushing by the resilient force of the second coiled spring, whilst with regards to the upward movement of the lead, in case the pipe member is moved upwards under the condition the lead is held, the lead holding force afforded by the lead holder bushing surpasses that given by the lead chuck so that the lead holding effect given by the lead chuck may be released or eliminated.

3. The drawing device as claimed in claim 1, characterized in that said driving arrangement connected to the sleeve of the drawing pencil comprises a pair of rollers; that is, a forwardly and reversely rotatable drive roller arranged to be urged to contact with the outer peripheral surface of the sleeve, and a forwardly and reversely rotatable driven or follower roller.

4. The drawing device as claimed in claim 1, characterized in that said driving arrangement connected to the sleeve of the drawing pencil comprises racks formed in the outer peripheral surface of the sleeve, and a pair of drive and driven pinions arranged to be engaged with said racks, respectively, and rotatable forwardly and reversely.

5. The drawing device as claimed in claim 1, characterized in that said drawing pencil comprises further a coiled spring loosely mounted on the outer peripheral surface of said pipe member between the upper end surface of said casing and the lower end surface of said sleeve so as to allow said pipe member to project through the sleeve to its predetermined upper position relative to said casing.

6. A drawing pencil comprising:

(a) a casing;

(b) a lead guide fixedly secured to the lower end of the casing;

(c) a pipe member slidably mounted in said casing;

(d) a chuck ring fixedly secured to the lower end of the pipe member;

(e) a sleeve tightly fitted and fixedly secured to the outer peripheral surface of the upper part of the pipe member;

(f) a lead stock slidably mounted in said pipe member and having a space for lead stock and a lead insertion hole formed or perforated longitudinally in the upper and lower parts thereof, respectively;

(g) a lead chuck fixedly secured to the lower end of the lead stock and having a longitudinally extending lead insertion hole formed therein so as to communicate rectilinearly with the lead insertion hole formed in said lead stock, said lead chuck being capable of deforming or expanding and contracting radially so as to achieve its lead holding function in cooperation with said chuck ring;

(h) a first coiled spring mounted between said chuck ring and said lead stock so as to bias normally upwards the lead stock and the lead chuck relative to said pipe member and said chuck ring;

(i) a means for radially contracting the lead chuck to enable the lead to be held by the lead chuck when the latter is biased upwards by the resilient force of the first coiled spring relative to the chuck ring; and (j) a coiled spring loosely mounted on the outer peripheral surface of said pipe member between the upper end surface of said casing and said sleeve so as to allow said pipe member to project through the sleeve to its predetermined upper position relative to said casing.

7. The drawing pencil as claimed in claim 6, characterized in that said lead guide has a large diameter hole, a small diameter hole, and a lead insertion hole formed continuously, concentrically and sequentially from the upper part to the lower part, said lead guide comprising:

(a) a holding cylinder tightly fitted in and fixedly secured to said large diameter hole;

(b) a lead holder bushing inserted in the holding cylinder and the small diameter hole so as to be moved up and down freely and having a large diameter outer peripheral portion kept in sliding contact with the inner peripheral surface of the holding cylinder on the side of the latter, an outer peripheral portion kept in sliding contact with the small diameter hole on the side of the latter, and a lead insertion hole formed in the central part thereof, said lead holder bushing being capable of slightly expanding and contracting in the radial direction; and (c) a second coiled spring mounted between the annular lower surface of the large diameter outer peripheral portion of the lead holder bushing and the bottom surface of said large diameter hold so as to bias normally the lead holder bushing upwards, wherein the lead holding force afforded by the lead holder cylinder is of a sufficient magnitude not only to prevent the lead from dropping by its own weight in the course of downward movement of the lead, but only to enable the lead chuck with the lead held thereby to be moved upwards through the lead against the resilient force of the first coiled spring in the course of upward movement of the lead holder bushing by the resilient force of the second coiled spring, whilst with regards to the upward movement of the lead, in case the pipe member is moved upwards under the condition the lead is held, the lead holding force afforded by the lead holder bushing surpasses that given by the lead chuck so that the lead holding effect given by the lead chuck may be released or eliminated.

* * * * *